US009765943B2

(12) United States Patent
De Oliveira

(10) Patent No.: US 9,765,943 B2
(45) Date of Patent: Sep. 19, 2017

(54) AIR HANDLING LIGHT FIXTURE

(71) Applicant: Hubbell Incorporated, Shelton, CT (US)

(72) Inventor: Avelino De Oliveira, Inman, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/874,763

(22) Filed: Oct. 5, 2015

(65) Prior Publication Data

US 2016/0097512 A1 Apr. 7, 2016

Related U.S. Application Data

(60) Provisional application No. 62/059,668, filed on Oct. 3, 2014.

(51) Int. Cl.

| | |
|---|---|
| ***F21V 7/00*** | (2006.01) |
| ***F21S 8/00*** | (2006.01) |
| ***F21V 29/505*** | (2015.01) |
| *F21V 29/83* | (2015.01) |
| *F21Y 101/00* | (2016.01) |
| *F21Y 115/10* | (2016.01) |

(52) U.S. Cl.

CPC ..... *F21V 7/005* (2013.01); *F21S 8/00* (2013.01); *F21V 29/505* (2015.01); *F21V 29/83* (2015.01); *F21Y 2101/00* (2013.01); *F21Y 2115/10* (2016.08)

(58) Field of Classification Search

CPC ..... F21V 7/005; F21V 29/505; F21V 29/83; F21S 8/00; F21Y 2101/00

See application file for complete search history.

(56) References Cited

U.S. PATENT DOCUMENTS

| | | | | |
|---|---|---|---|---|
| 3,803,401 | A * | 4/1974 | Drews | F21V 29/83 362/218 |
| 2003/0148730 | A1 | 8/2003 | Crane | |
| 2008/0019126 | A1 | 1/2008 | Straton et al. | |
| 2009/0279297 | A1* | 11/2009 | Plunk | F21S 8/02 362/235 |
| 2010/0172133 | A1* | 7/2010 | Liu | F21S 8/02 362/235 |
| 2013/0163237 | A1 | 6/2013 | Tsai | |

FOREIGN PATENT DOCUMENTS

| | | |
|---|---|---|
| JP | 2010170743 | 8/2010 |

OTHER PUBLICATIONS

PCT/US2015/053996 International Search Report and Written Opinion dated Dec. 30, 2015.

* cited by examiner

*Primary Examiner* — Y M. Lee
(74) *Attorney, Agent, or Firm* — Michael Best & Friedrich, LLP

(57) ABSTRACT

A luminaire includes a reflector having a central channel for receiving a light emitter, a first side portion extending from the central channel in a first direction, and a second side portion extending from the central channel in a second direction. A first set of apertures extends through the first side portion and a second set of apertures extends through the second side portion.

14 Claims, 4 Drawing Sheets

AIR HANDLING LIGHT FIXTURE

RELATED APPLICATION(S)

This application is based on U.S. provisional application Ser. No. 62/059,668, filed Oct. 3, 2104, the disclosure of which is incorporated herein by reference in its entirety and to which priority is claimed.

FIELD

Various exemplary embodiments of the invention relate to luminaires.

BACKGROUND

Luminaires, or light fixtures, are used with electric light sources to provide aesthetic and functional housing in both interior and exterior applications. Various types of interior luminaires include overhead, troffer, ceiling, or suspended luminaires, which are designed to be positioned near, in, or suspended from, the ceiling or a drop ceiling. Interior luminaires require thermal management considerations to dissipate heat from the luminaires and the light sources.

SUMMARY

According to an exemplary embodiment, reflector for a luminaire includes a central channel for receiving a light emitting element. A first side portion extends from the central channel in a first direction. A second side portion extends from the central channel in a second direction. A first end portion extends from the first side portion. A second end portion extends from the second side portion. A first set of apertures extends through the first side portion. A second set of apertures extends through the second side portion.

According to another exemplary embodiment, a luminaire includes a first end cap, a second end cap, a lens, and a reflector. The lens and the reflector extend between the first and second end caps. The reflector has a central channel, a first side portion extending from the central channel in a first direction, and a second side portion extending from the central channel in a second direction. A first set of apertures extends through the first side portion and a second set of apertures extending through the second side portion.

According to another exemplary embodiment, a reflector for a luminaire includes a central channel. A first side portion extends from the central channel in a first direction. A second side portion extends from the central channel in a second direction. A first end portion extends from the first side portion. A second end portion extends from the second side portion. A first set of apertures extends through the first side portion. A second set of apertures extends through the first side portion. A third set of apertures extends through the second side portion. A fourth set of apertures extends through the second side portion.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
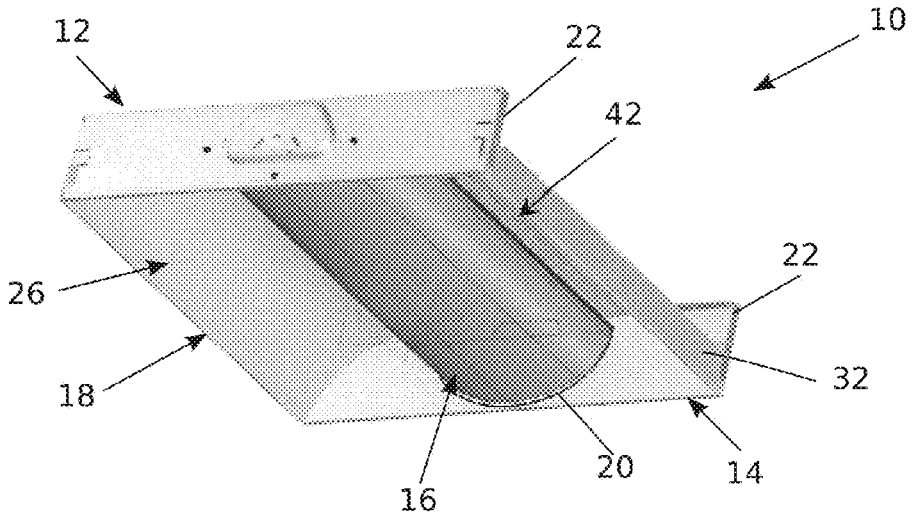
FIG. 1 is a bottom perspective view of an exemplary luminaire.
Figure 2:
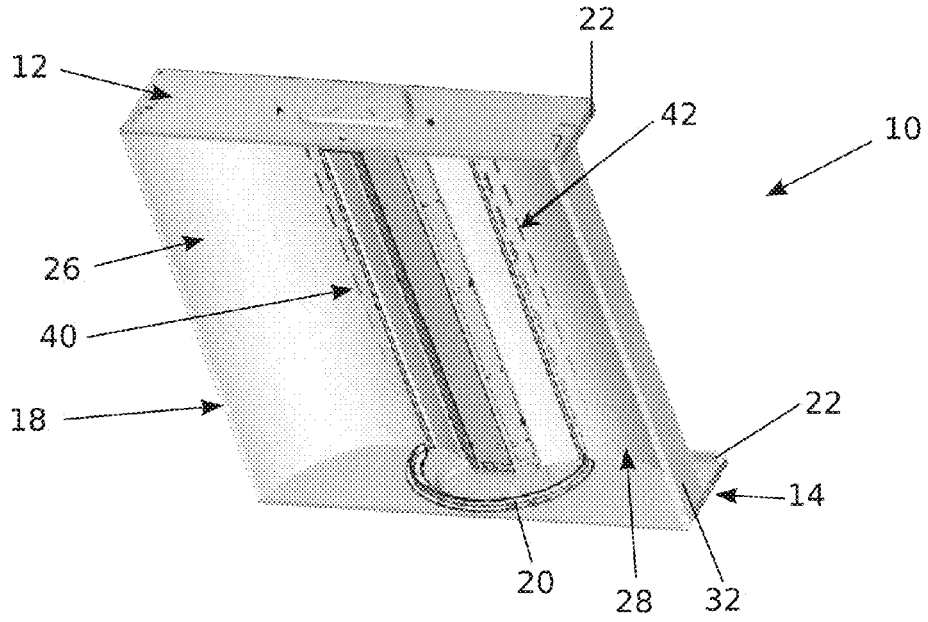
FIG. 2 is a bottom perspective view of the luminaire of FIG. 1 with the lens removed.

FIGS. 1 and 2 depict an exemplary embodiment of a luminaire 10 including a first end cap 12, a second end cap 14, a lens 16, and a reflector 18. The luminaire 10 is configured to receive a light emitter or module (not shown). The light emitting element can include one or more light emitting diodes (LEDs) positioned in the reflector 18 and covered by the lens 16. The exemplary luminaire 10 is designed as a recessed lighting unit to be placed into a ceiling and can be held in place by a frame, drop ceiling, or other support structure.

The first and second end caps 12, 14 include a semi-circular central flange 20 for retaining the lens 16. The size, shape, and configuration of the central flange 20 can vary depending on the type of lens 16 and the type of light element. The first and second end caps 12, 14 also include side flanges 22 and a mounting feature (not shown), for example a protrusion or clip, for connecting the first and second end caps 12, 14 to the reflector 18.

Figure 3:
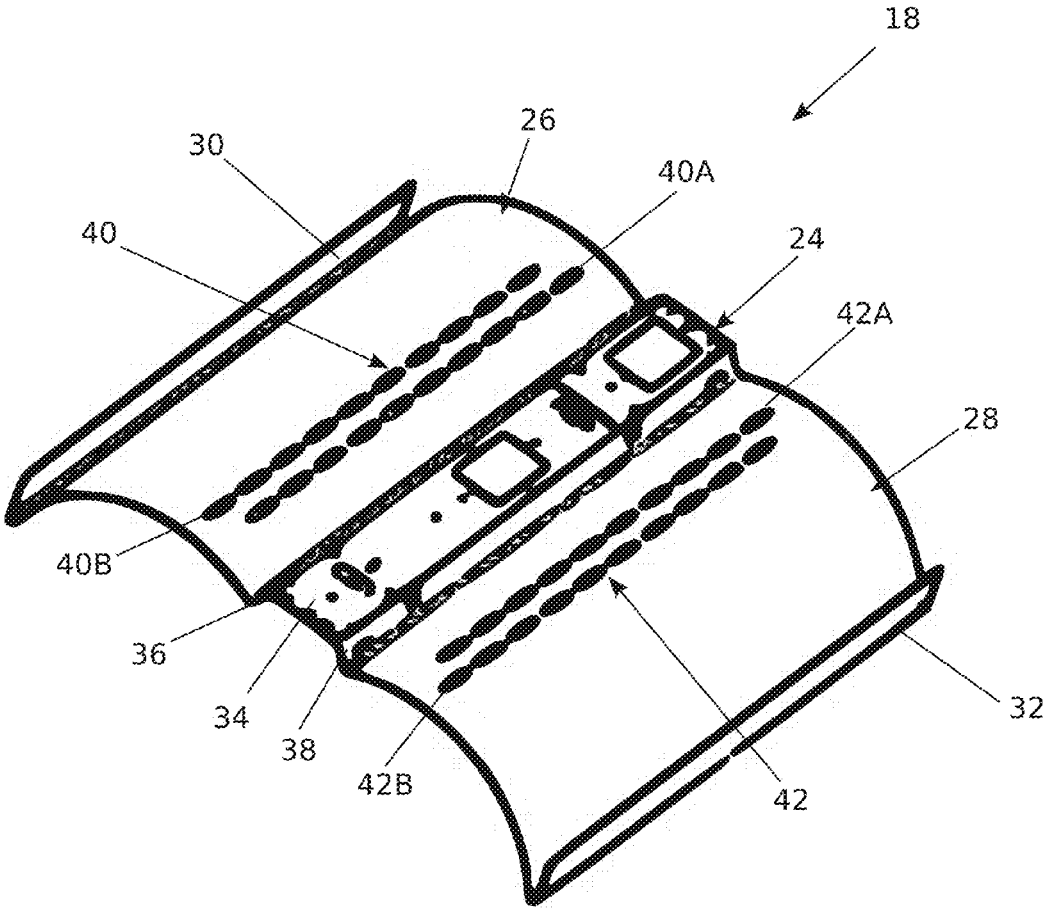
FIG. 3 is a top perspective view of an exemplary reflector.
Figure 4:
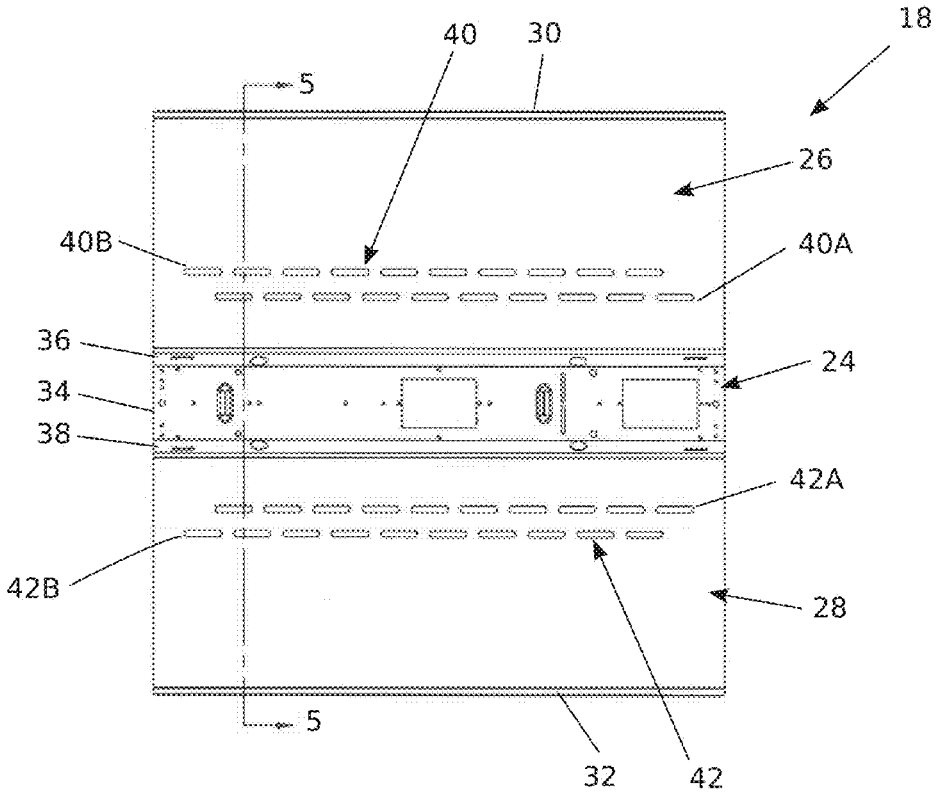
FIG. 4 is a bottom view of the reflector of FIG. 3.
Figure 5:
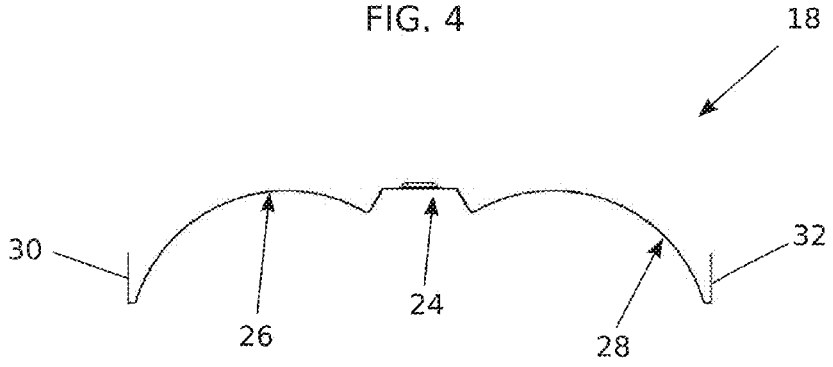
FIG. 5 is a sectional view of the reflector of FIG. 4 taken along line 5-5.

FIGS. 3-5 depict an exemplary embodiment of a reflector 18, having a central channel 24, a first side portion 26, a second side portion 28, a first end portion 30 and a second end portion 32. The reflector 18 can be a unitary, monolithic structure or formed from multiple pieces. The reflector may be made from a plastic, metal, ceramic, or composite material, or any combination thereof. In various exemplary embodiments, the reflector 18 is made from metal, or any other stiff, lightweight material.

In an exemplary embodiment, the central channel 24 includes a base 34, a first sidewall 36, and a second side wall 38. The base 34 includes a series of mounting features and openings to receive a light element and to allow for electrical connection to the light element from a power source, such as a driver or junction box.

The first and second side portions 26, 28 extend from the central channel 24 to the first and second ends 30, 32, respectively. In an exemplary embodiment, the first and second side portions 26, 28 are curved, although any rectilinear or curvilinear configuration can be used. The first side portion 26 includes a first aperture set 40 and the second side portion 28 includes a second aperture set 40. The first and second aperture sets 40, 42 each include one or more apertures extending through the respective sides to allow airflow through the reflector. The apertures are shown as substantially obround, although any rectilinear, curvilinear, or combination shapes may be used. The size, spacing, and configuration of the apertures can also vary depending on the reflector, light element, and the desired airflow characteristics, In the exemplary embodiment shown in FIGS. 3 and 4, the first and second aperture sets 40, 42 include a first row of apertures 40A, 42A and a second row of apertures 40B, 42B, with the first row of apertures 40A, 42A spaced closer to the central channel 24 than the second row of apertures 40B, 42B. The apertures in each row are offset, so that the first row of apertures 40A, 42A is spaced closer to a rear edge of the reflector 18 and the second row of apertures 40B, 42B is spaced closer to a front edge of the reflector 18. The number of apertures in each row can vary, dependent on, for example the size of the reflector 18, and the desired airflow.

The position of the first and second aperture sets 40, allows sufficient airflow through the reflector 18, and can minimizing the aesthetic impact of the apertures, the amount of light lost through the apertures, and/or the impact on the reflective capabilities of the reflector 18. In an exemplary embodiment, the first and second aperture sets 40, 42 are positioned closer to the central channel 24 than to the first and second end portions 30, 32 respectively. In another exemplary embodiment, the first and second aperture sets 40, 42 are positioned closer to the central channel 24 than to a midpoint of the first and second side portions 26, 28, respectively, measured from the central channel 24 to the first and second end portions 30, 32.

In another exemplary embodiment, the first and second aperture sets 40, 42 are positioned so that at least a portion of the first and second aperture sets 40, 42 are covered by the lens 16 when the luminaire is assembled. For example, as shown in FIG. 1, the first row of apertures 40A, 42A can be at least partially, or entirely, covered by the lens 16. The apertures can be considered covered by the lens 16 when the lens 16 is positioned below the apertures, or when a viewer is incapable of seeing at least a portion of the apertures from a certain angle, for example from below the luminaire. The apertures remain spaced from the lens 16, because of the curved first and second side portions 26, 28, so that airflow is maintained even when the lens 16 is covering the apertures.

Figure 6:
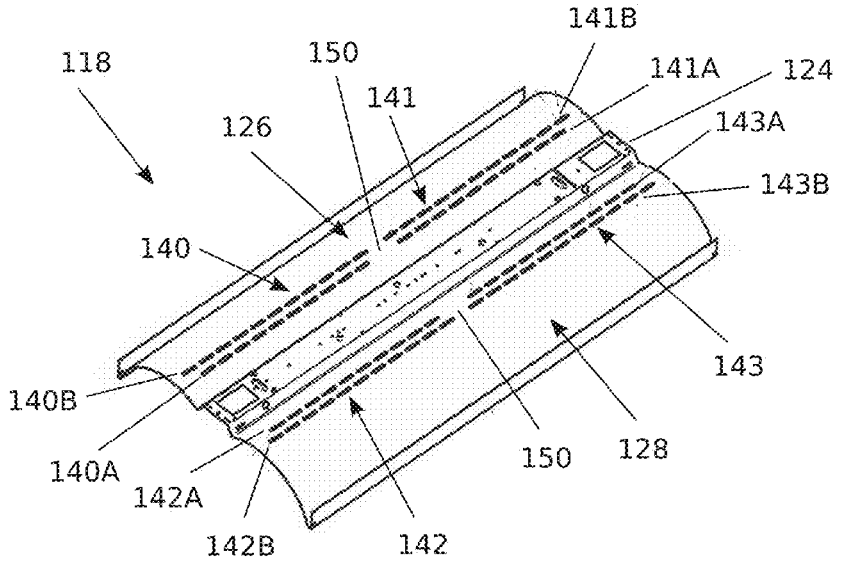
FIG. 6 is a top perspective view of another exemplary reflector.
Figure 7:
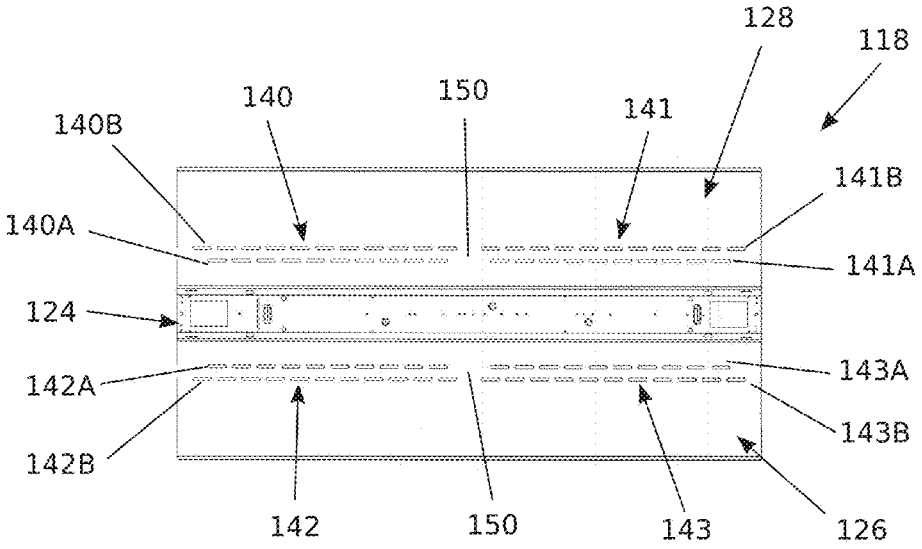
FIG. 7 is a bottom view of the reflector of FIG. 6.

FIGS. 6 and 7, show another exemplary reflector 118 having a plurality of apertures. The reflector 118 of FIGS. 6 and 7 is longer than the reflector 18 of FIGS. 3-5. The reflector 118 includes a first and second set of apertures 140, 141 on the first side portion 126 and a third and fourth set of apertures 142, 143 on the second side portion 128. A center space 150 separates the first set of apertures 140 from the second set of apertures 141 and the third set of apertures 142 from the fourth set of apertures 143. Each set of apertures includes a first row 140A, 141A, 142A, 143A and a second row 140B, 141B, 142B, 143B, with the first row 140A, 141A, 142A, 143A spaced closer to the central channel 124. The apertures in each row are offset and the second row of apertures 140B, 141B, 142B, 143B extends past the first row of apertures 140A, 141A, 142A, 143A in each set and on each side.

The first through fourth aperture sets 140-143 can be similarly positioned to the first and second aperture sets 40, 42 of the exemplary reflector shown in FIGS. 3-5 and described above.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

The invention claimed is:

1. A reflector for a luminaire comprising:

a central channel for receiving a light emitting element;

a first side portion extending from the central channel in a first direction;

a second side portion extending from the central channel in a second direction;

a first end portion extending from the first side portion;

a second end portion extending from the second side portion;

a first set of apertures including a first row of apertures and a second row of apertures extending through the first side portion; and a second set of apertures extending through the second side portion, wherein the first and second sets of apertures are positioned closer to the central channel than to a midpoint of the first and second side portions, respectively, measured from the central channel to the first and second end portions.

2. The reflector of claim 1, wherein the first row of apertures is offset from the second row of apertures.

3. The reflector of claim 1, wherein the first row of apertures is positioned closer to a rear edge of the first side portion and the second row of apertures is positioned closer to a front edge of the first side portion.

4. The reflector of claim 1, wherein the first side portion and the second side portion are curved.

5. The reflector of claim 1, wherein the apertures are substantially obround.

6. A luminaire comprising:

a first end cap;

a second end cap;

a lens extending between the first and second end caps; and a reflector extending between the first and second end caps, the reflector having a central channel, a first side portion extending from the central channel in a first direction, a second side portion extending from the central channel in a second direction, a first set of apertures extending through the first side portion, and a second set of apertures extending through the second side portion, wherein the first side portion extends beyond the lens in a first direction and the second side portion extends beyond the lens in a second direction, and wherein at least a portion of the first and second sets of apertures are covered by the lens.

7. The luminaire of claim 6, wherein the first set of apertures includes a first row of apertures and a second row of apertures and the second set of apertures includes a third row of apertures and a fourth row of apertures.

8. The luminaire of claim 7, wherein at least a portion of the first and third rows of apertures are covered by the lens.

9. The luminaire of claim 6, wherein the first and second end cap each include a flange for supporting the lens.

10. The luminaire of claim 6, wherein the first side portion and the second side portion are curved.

11. A reflector for a luminaire comprising:

a central channel;

a first side portion extending from the central channel in a first direction;

a second side portion extending from the central channel in a second direction;

a first end portion extending from the first side portion;

a second end portion extending from the second side portion;

a first set of apertures extending through the first side portion;

a second set of apertures extending through the first side portion;

a third set of apertures extending through the second side portion; and a fourth set of apertures extending through the second side portion, wherein the first, second, third, and fourth sets of apertures are positioned closer to the central channel than to a midpoint of the first and second side portions, respectively, measured from the central channel to the first and second end portions.

12. The reflector of claim 11, wherein the first set of apertures is spaced from the second set of apertures and the third set of apertures is spaced from the fourth set of apertures.

13. The reflector of claim 11, wherein the first set of apertures includes a first row of apertures and a second row of apertures.

14. The reflector of claim 13, wherein the first row of apertures extends past the second row of apertures on a front side and a rear side.

* * * * *